US011326402B2

(12) United States Patent
Tu et al.

(10) Patent No.: US 11,326,402 B2
(45) Date of Patent: May 10, 2022

(54) HYBRID BIT WITH ROLLER CONES HAVING INSERTS

(71) Applicant: KINGDREAM PUBLIC LIMITED COMPANY, Hubei (CN)

(72) Inventors: Guanfu Tu, Hubei (CN); Qiang Liu, Hubei (CN); Xiaobo Liu, Hubei (CN); Shigui Jiang, Hubei (CN)

(73) Assignee: KINGDREAM PUBLIC LIMITED COMPANY, Hubei (CN)

( * ) Notice: Subject to any disclaimer, the term of this patent is extended or adjusted under 35 U.S.C. 154(b) by 0 days.

(21) Appl. No.: 16/956,395

(22) PCT Filed: Nov. 1, 2018

(86) PCT No.: PCT/CN2018/113248
§ 371 (c)(1),
(2) Date: Jun. 19, 2020

(87) PCT Pub. No.: WO2019/119987
PCT Pub. Date: Jun. 27, 2019

(65) Prior Publication Data

US 2021/0087886 A1 Mar. 25, 2021

(30) Foreign Application Priority Data

Dec. 21, 2017 (CN) ..... 201711396639.6

(51) Int. Cl.
*E21B 10/14* (2006.01)
*E21B 10/18* (2006.01)
(Continued)

(52) U.S. Cl.
CPC ..... *E21B 10/14* (2013.01); *E21B 10/16* (2013.01); *E21B 10/18* (2013.01); *E21B 10/50* (2013.01); *E21B 10/60* (2013.01)

(58) Field of Classification Search
CPC ..... E21B 10/14; E21B 10/18; E21B 10/16
See application file for complete search history.

(56) References Cited

U.S. PATENT DOCUMENTS 4,444,281 A * 4/1984 Schumacher, Jr. ..... E21B 10/14 175/336
2005/0273302 A1* 12/2005 Huang ..... E21B 44/00 703/10

(Continued)

FOREIGN PATENT DOCUMENTS

CN 103015899 A 4/2013
CN 105113995 A 12/2015

(Continued)

OTHER PUBLICATIONS

Office Action received in Chinese Patent Application No. 201711396639, dated Apr. 10, 2019.
Office Action received in Chinese Patent Application No. 201711396639, dated May 29, 2020.
Search Report received in parent International Patent Application No. PCT/CN2018/113248, dated Jan. 18, 2019.

*Primary Examiner* — Cathleen R Hutchins
(74) *Attorney, Agent, or Firm* — Kilpatrick Townsend & Stockton LLP

(57) ABSTRACT

A hybrid bit with roller cones having inserts is disclosed, includes a bit body, blades and roller cones. All the fixed cutting elements at the inner cone section, nose section and shoulder section of blades herein constitutes two sets of corresponding fixed cutting elements respectively, forming two profile envelopes of fixed cutting elements at least in the interval at the nose section and shoulder section, the two profile envelopes of fixed cutting elements are spaced at high and low intervals at the nose section and shoulder section, forming two stages of cutting by fixed cutting elements; and the cutting position of the cone insert mainly corresponds to the nose section and shoulder section of blades, the outermost cutting profile envelope of cone inserts formed by all or part of cutting elements on cones herein is (Continued)

higher than the outermost cutting profile envelope of fixed cutting elements, forming the third stage of cutting. The invention can effectively develop rate of penetration in hard and plastic formation, maintain and prolong the service life of the hybrid bit, and broaden the formation suitability of the hybrid bit.

12 Claims, 3 Drawing Sheets

(51) Int. Cl.

| | |
|---|---|
| ***E21B 10/16*** | (2006.01) |
| ***E21B 10/50*** | (2006.01) |
| ***E21B 10/60*** | (2006.01) |

(56) References Cited

U.S. PATENT DOCUMENTS

| | | | | |
|---|---|---|---|---|
| 2016/0108680 | A1 | 4/2016 | Rothe | |
| 2017/0175450 | A1* | 6/2017 | Poteet, III | E21B 10/14 |

FOREIGN PATENT DOCUMENTS

| | | | |
|---|---|---|---|
| CN | 105781426 | A | 7/2016 |
| CN | 106437525 | A | 2/2017 |
| CN | 107905737 | A | 4/2018 |
| CN | 207795065 | U | 8/2018 |
| WO | 2010080477 | A2 | 7/2010 |

* cited by examiner

HYBRID BIT WITH ROLLER CONES HAVING INSERTS

The present disclosure is a national stage application of PCT/CN2018/113248, having an application date of Nov. 1, 2018, which is based on the Chinese patent application with an application number 201711396639.6 and an application date of Dec. 21, 2017, and claims the priority thereof, and the disclosure contents of the patent applications are herein incorporated by reference.

FIELD OF THE DISCLOSURE

The present disclosure relates to a hybrid bit with roller cone having inserts in petroleum, natural gas and geological drilling, which is suitable for the penetration in stringer, hard formation and hard & plastic formation.

BACKGROUND OF THE ART

In present technologies, a conventional polycrystalline diamond cutter (PDC) bit drills at bottom-hole through scraping when encountering hard formation during drilling, the main cutting elements are difficult to penetrate into rocks at bottom hole, so the rate-of-penetration (ROP) of a diamond bit becomes very slow while a roller cone bit fractures rock through crushing, deeper broken pits are easy to be produced. Due to hard formation, volumetric fracture in rock cannot be produced, and hence the ROP of a roller cone bit is very slow.

On the other hand, when encountering formation with staggered stringers from soft to hard, the cutting elements of a PDC bit tend to be broken by impact. In order to cope with the condition, a roller cone and PDC hybrid bit with relatively high comprehensive property is put forward to improve its ROP by making preliminary breakage to formation through cones to release formation stress, and then scraping the formation through cutters in fixed blades, and meanwhile, the cutters in fixed blades are protected well to prolong its service life. Although this kind of bit can develop its ROP and service life in stringers and hard formation effectively, the ROP is relatively slow when encountering hard & plastic formation, because it is difficult for the tungsten carbide inserts in the cones and cutters in the fixed blades to penetrate into formation.

SUMMARY OF THE DISCLOSURE

A hybrid bit with roller cones having three stages of cutting inserts includes a bit body, having blades and nozzles mounted. The blade includes inner cone section, nose section, shoulder section and gage section from inside to outside, with fixed cutting elements mounted along the inner cone section, nose section, shoulder section and gage section. A head is disposed between at least two adjacent blades with its upper end integrated with the bit body, and a roller cone is disposed at the lower end of the head. Fixed cutting elements are arranged at the inner cone section, nose section and shoulder section of blades herein from inside to outside, to cover the whole bottom hole and form the cutting profile envelope of fixed cutting elements. All the fixed cutting elements at the inner cone section, nose section and shoulder section of the blades herein constitute two sets of corresponding fixed cutting elements respectively, and two profile envelopes are formed by the fixed cutting elements herein spaced at least at nose and shoulder. The two cutting profile envelopes of fixed cutting elements are spaced at high and low intervals at the nose section and shoulder section to form two stages of cutting. Cones are roller cones with inserts, and the cutting faces of the cones correspond to the nose section and shoulder section of blades. The outermost cutting profile envelope of cone inserts formed by all or part of cutting elements on cones herein is higher than the outermost cutting profile envelope of fixed cutting elements, to form the third stage of cutting.

In some embodiments, the outermost cutting profile envelope of the cone inserts is 0.5 mm to 2 mm higher than the outermost cutting profile envelope of fixed cutting element.

In some embodiments, the outermost cutting profile envelope of cone inserts and the outermost cutting profile envelope of fixed cutting elements are at parallel interval.

In some embodiments, all the cone inserts constitute two sets of corresponding cone inserts, and the two sets of cone inserts respectively form two spaced cutting profile envelope of cone inserts, a part of cone inserts form the outermost cutting profile envelope, and the other part of cone inserts form a secondary cutting profile envelope, the outmost profile envelope is 0.5-2 mm higher than the secondary cutting envelope.

In some embodiments, the two cutting profile envelopes with fixed cutting elements are spaced at high and low intervals in the inner cone.

In some embodiments, the space between two cutting profile envelopes of fixed cutting elements is 0.2~2 mm.

In some embodiments, the gyration radiuses of all fixed cutting elements at each blade are different from each other, that is, the structure of cutter placement at each blade is different from each other, and the cutting trajectory of each cutting element at bottom-hole is different from each other as well.

In some embodiments, when the cone inserts are at the lowest point of cutting trajectory, the center line of the inserts overlaps with or approximates to the center line of each corresponding cutting elements at blades.

In some embodiments, the number of blades is 2 to 6, the number of roller cones is 2 to 4; and the number of roller cones is less than or equal to that of the blades.

In some embodiments, the cone inserts of a hybrid bit with roller cones having inserts are tungsten carbide inserts, or cemented carbide and PDC mixed cutting elements.

In some embodiments, the fixed cutting elements of a hybrid bit with roller cones having inserts are polycrystalline diamond cutters.

The beneficial effects of the disclosure lie in: 1. The cone inserts are higher than the fixed cutting elements and the fixed cutting elements are spaced at difference height at nose section and shoulder section, to form three stages of cutting with different height. When penetrating into hard and plastic formation, the aggressiveness of fixed cutting elements can be improved effectively, and hence the ROP of the bit can be developed accordingly; 2. Due to the protection to the fixed cutting elements of the same cutting trajectory with that of cone inserts at nose and shoulder of a bit, impact breaking of fixed cutting elements can be reduced effectively to prolong the service life of the bit; 3. The hybrid bit can make a fragmentation to hard and plastic formation and broaden its formation suitability by enhancing its aggressiveness and comprehensive performance effectively.

So that the manner in which the features and advantages of the present invention, which will become apparent, in view of detailed description of the exemplary embodiments of the present invention through the appended drawings

BRIEF DESCRIPTION OF THE ATTACHED DRAWINGS

In order to explain the exemplary embodiments of the present invention or the technical proposal of present technologies clearly, description of the invention briefly summarized in the following may be had by reference to the embodiments thereof that are illustrated in the appended drawings which form a part of this specification. It's to be noted that, the drawings illustrated are only some embodiments of the disclosed invention, and for ordinary technicians of this field, other drawings can be attained without their creative labor.

DETAILED EMBODIMENT OF THE DISCLOSURE

In combination with the appended drawings in the exemplary embodiments of the disclosure, the technical proposal in the exemplary embodiments of the disclosure is described clearly and completely. It's to be noted, however, that the drawings illustrate only some embodiments of the disclosure and therefore are not to be considered limiting of its scope as the disclosure may admit to other equally effective disclosure; While the disclosure has been shown or described in only some of its forms, it should be apparent to those skilled in the art that it is not so limited, but is susceptible to various changes without departing from the scope of the disclosure. Based on the embodiments in the disclosure, all other embodiments obtained by ordinary technicians in this field without the premise of carrying out creative labor shall fall within the scope of this disclosure protection.

Embodiment No. 1

Figure 1:
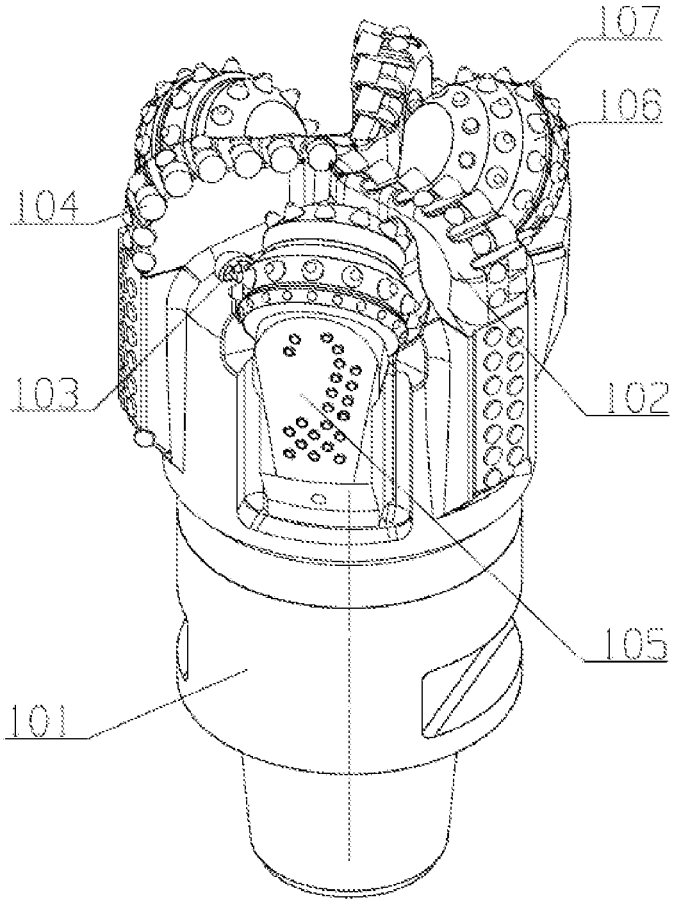
FIG. 1 shows the stereo-structure schematic diagram of a hybrid bit with roller cones having three stages of cutting inserts at the first exemplary embodiment in this disclosure.
Figure 2:
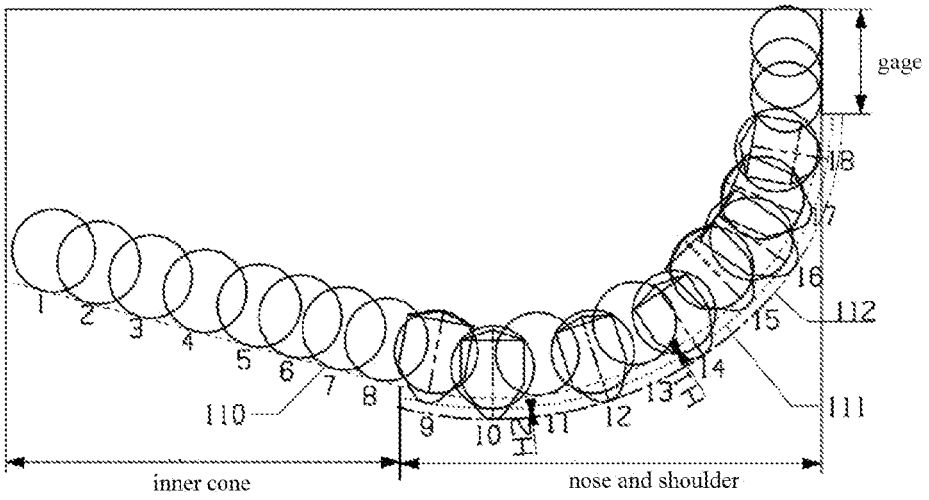
FIG. 2 shows the projection diagram on the cutting profile envelopes of cone inserts and fixed cutting elements of a hybrid bit with roller cones having three stages of cutting inserts at the first exemplary embodiment in this disclosure.
Figure 3:
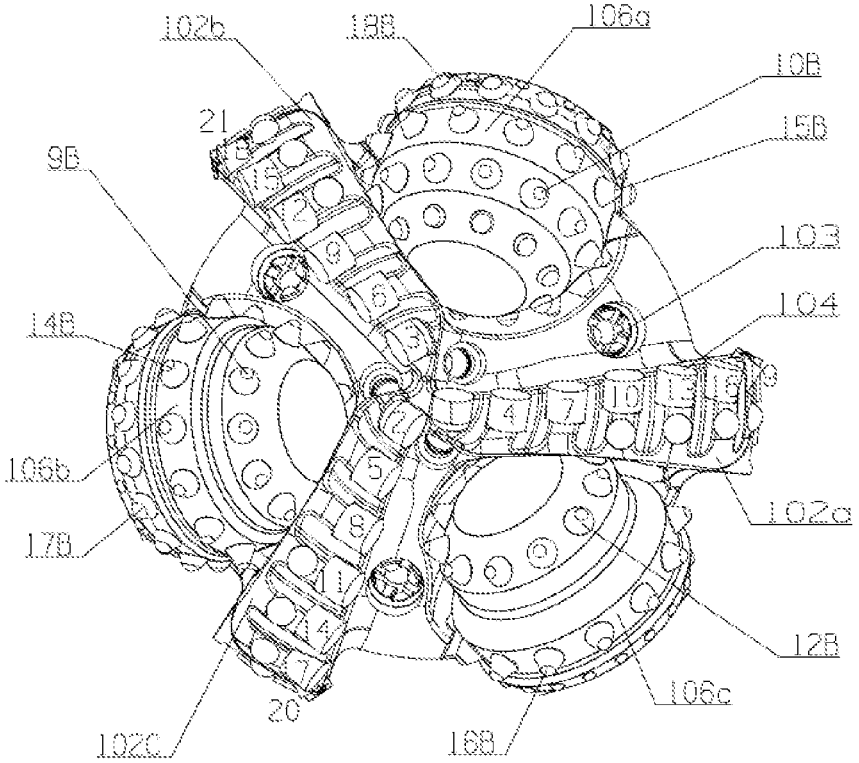
FIG. 3 is the top view of a hybrid bit with roller cones having three stages of cutting inserts shown in FIG. 1.

As shown in FIG. 1 to FIG. 3, the embodiment provides a new kind of roller cone having inserts and PDC hybrid bit includes a bit body 101, having three blades 102 and six nozzles 103 mounted. The blade includes the inner cone, nose, shoulder and gage sections from inside to outside, with fixed cutting elements 104, which are PDC cutters, mounted along the inner cone, nose, shoulder and gage sections. Fixed cutting elements 104 of the blades cover the whole bottom hole, and the cutting trajectories of fixed cutting elements of the blades are different from each other. All the fixed cutting elements herein constitute two sets of corresponding fixed cutting elements respectively and form two cutting profile envelopes 110, 111 by the fixed cutting elements, which are parallel and spaced from each other. The two profile envelopes of fixed cutting elements are spaced at high and low intervals at nose and shoulder sections with the interval H1 of 1 mm to form two stages of cutting of fixed cutting elements. As shown in FIG. 2 and FIG. 3, No. 1 to No. 18 fixed cutting elements are located at three different blades 102*a*, 102*b* and 102*c* respectively, the fixed cutting elements arranged outwards along the axis of the bit body, to cover the whole bottom-hole, and the cutting trajectories of the fixed cutting elements are different from each other. A head 105 is disposed between two adjacent blades, with its upper end welded to be integrated with the bit body, and a journal pin disposed at its lower end, a roller cone 106 mounted into the journal pin axially fixed with steel balls, and cones and blades are in alternate arrangement. Cones herein are roller cones with inserts, there are three roller cones 106*a*, 106*b* and 106*c*, cone inserts 107 are cemented carbide inserts and mounted at the roller cones 106, the cutting face of cone insert herein corresponds to the nose section and shoulder section of a blade. There are multiple rows of cone inserts, with each row of them disposed at intervals along a round of cone weft, and closely arranged from inside to outside along two spaced cutting profile envelope formed by cone inserts. The outermost cutting profile envelope 112 is formed by one part of cone inserts, and the secondary cutting profile envelope formed by the other part of cone inserts. The outermost cutting profile envelope is higher than the secondary cutting profile envelope and the two profile envelopes are at parallel space with interval H2 of 1 mm, among which the outermost cutting profile envelope 112 of cone inserts s higher than the outermost profile envelope 111 of fixed cutting elements, forming the third stage of cutting of a hybrid bit.

During drilling, the nose section and shoulder section cover the formation which is fractured by rotary impact of cone insert rows 10B, 12B, 14B and 16B, and then the preliminary broken pits are enlarged by corresponding No. 10, 12, 14 and No. 16 fixed cutting elements, and meanwhile rows of cone inserts 9B, 15B, 17B and 18B fracture the formation by rotary impact, forming preliminary broken pits with different radiuses, in the end, the formation is fractured by shearing of fixed cutting elements 9, 11, 13, 15, 17 and 18, and hence highly efficient fragmentation to the formation is not only realized, but also PDC fixed cutting elements are protected effectively.

Embodiment No. 2

Figure 4:
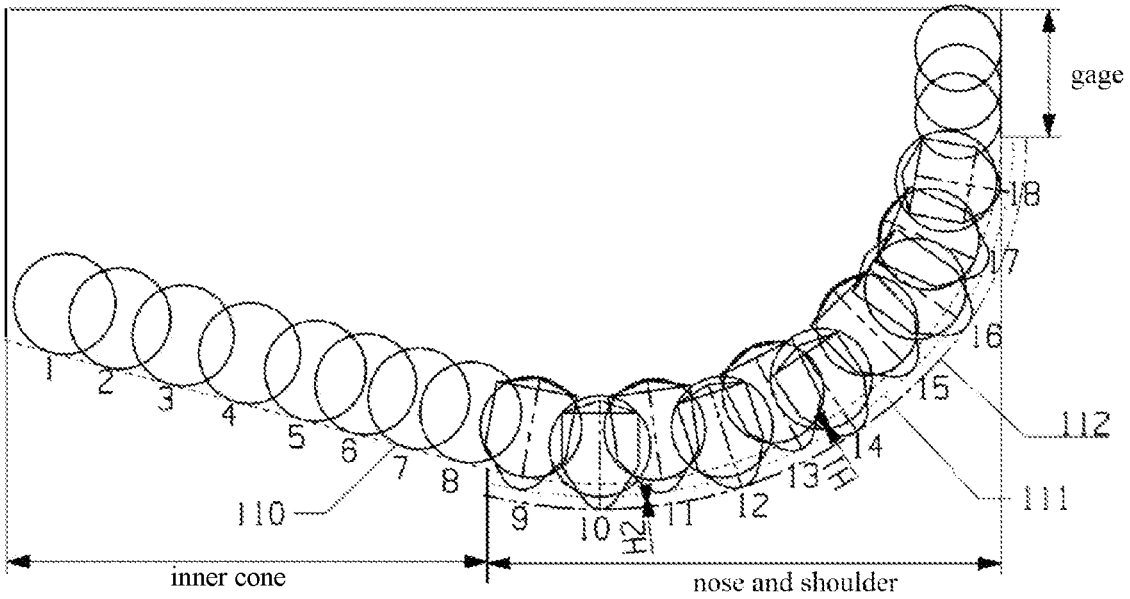
FIG. 4 is the projection diagram of cutting profile envelopes of cone inserts and fixed cutting elements at the second exemplary embodiment in this invention.

As shown in FIG. 4, the main difference between embodiment No. 1 and this embodiment lies in: at the lowest point of cutting trajectory, the cutting elements of the cones overlap with the center line of each corresponding fixed cutting element at nose and shoulder of the blades.

Embodiment No. 3

Figure 5:
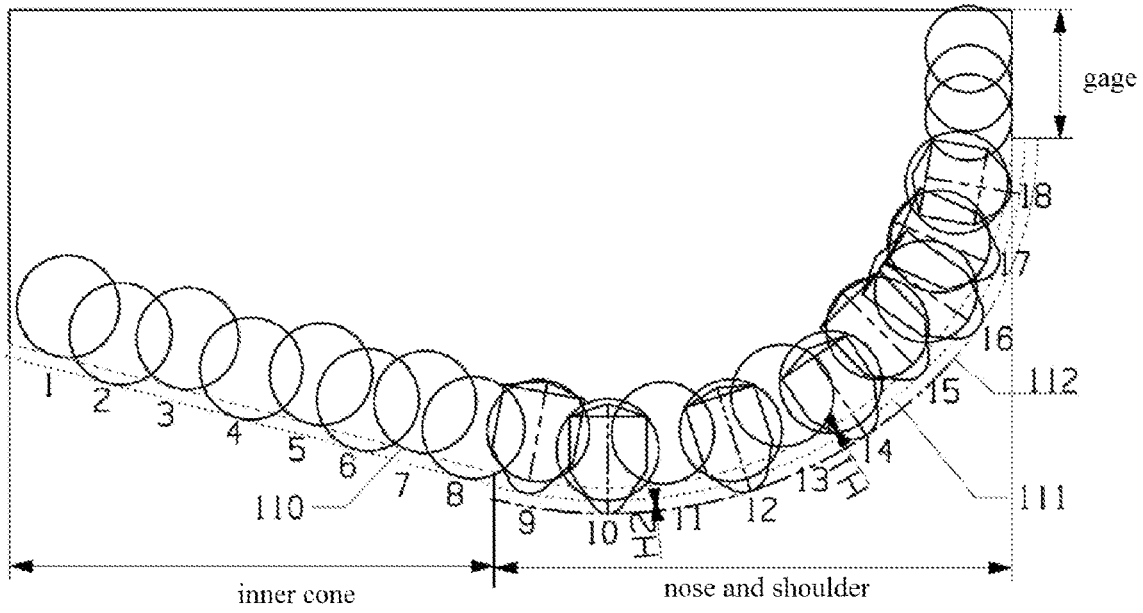
FIG. 5 is the projection diagram of cutting profile envelopes of cone inserts and fixed cutting elements at the third exemplary embodiment in this invention.

As shown in FIG. 5, the main difference between embodiment No. 1 and this embodiment lies in: there are two profile envelopes of fixed cutting elements at the inner cone section of the hybrid bit, the two profile envelopes are spaced at parallel, high and low intervals, which are tangent to the two cutting profile envelopes of the fixed cutting elements 110 and 111 at parallel intervals at the shoulder section and nose section.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A hybrid bit with roller cones having inserts, comprising:

a bit body;

blades disposed on the bit body;

a plurality of fixed cutting elements arranged side by side along an outer edge of the blades;

roller cones mounted on the bit body and alternately arranged with the blades along the circumferential direction of the bit body;

wherein the outer edge of the blades comprises an inner cone section, a nose section, a shoulder section and a gage section arranged sequentially along a direction away from the axis of the bit body; and wherein the hybrid bit with roller cones having inserts comprises two sets of the fixed cutting elements, with each set of the fixed cutting elements comprising a plurality of the fixed cutting elements arranged along the direction away from the axis of the bit body, two sets of cutting profile envelopes of the fixed cutting elements are a first cutting profile envelope and a second cutting profile envelope respectively, the second cutting profile envelope is farther away from the axis of the bit body than the first cutting profile envelope at the nose section and the shoulder section, a cutting profile envelope of cone inserts is a third cutting profile envelope, the second cutting profile envelope is closer to the axis of the bit body than the third cutting profile envelope at the nose section and shoulder section, the hybrid bit with roller cones having inserts comprising two sets of the cone inserts, each set of the cone inserts comprises a plurality of the cone inserts arranged along the direction away from the axis of the bit body, distances between one of cutting profile envelopes of the two sets of cone inserts and the axis of the bit body and between the other of cutting profile envelopes of the two sets of cone inserts and the axis of the bit body are different.

2. The hybrid bit with roller cones having inserts according to claim 1, wherein a nozzle for jetting cutting fluid are mounted at the bit body.

3. The hybrid bit with roller cones having inserts according to claim 1, further comprising a head disposed between two adjacent blades, with an upper end of the head connected with the bit body, and the roller cone mounted at the lower end of the head.

4. The hybrid bit with roller cones having inserts according to claim 1, wherein, the second cutting profile envelope is lower than the first cutting profile envelope at the nose section and shoulder section; and the second cutting profile envelope is higher than the third cutting profile envelope at the nose section and shoulder section.

5. The hybrid bit with roller cones having inserts according to claim 1, wherein the third cutting profile envelope is 0.5~2 mm farther away from the bit body than the second cutting profile envelope.

6. The hybrid bit with roller cones having inserts according to claim 1, wherein the third cutting profile envelope is at least partially parallel to and spaced from the second cutting profile envelope.

7. The hybrid bit with roller cones having inserts according to claim 1, wherein the cutting profile envelope of one of the two sets of cone inserts is 0.5~2 mm farther away from the axis of the bit body than the cutting profile envelope of the other of the two sets of cone inserts.

8. The hybrid bit with roller cones having inserts according to claim 1, wherein the second cutting profile envelope is 0.2~2 mm farther away from the axis of the bit body than the first cutting profile envelope.

9. The hybrid bit with roller cones having inserts according to claim 1, wherein gyration radiuses of all fixed cutting elements at the blades are different from each other, and the cutting trajectories of cutting elements are different from each other.

10. The hybrid bit with roller cones having inserts according to claim 1, wherein a cutting trajectory of the cone insert at the lowest point overlaps with or approximates to a cutting trajectory of one of the fixed cutting elements on the blades.

11. The hybrid bit with roller cones having inserts according to claim 1, wherein, the number of the blades is 2 to 6;

the number of the roller cones is 2 to 4; and the number of roller cones is less than or equal to that of the blades.

12. The hybrid bit with roller cones having inserts according to claim 1, wherein, the cone inserts are cemented carbide inserts or cemented carbide and PDC mixed cutting elements; and the fixed cutting elements are polycrystalline diamond cutters.

* * * * *